US012270280B2

(12) United States Patent
Aljuaydi et al.

(10) Patent No.: US 12,270,280 B2
(45) Date of Patent: Apr. 8, 2025

(54) DOWNHOLE SCALE REMOVAL TOOL

(71) Applicant: SAUDI ARABIAN OIL COMPANY, Dhahran (SA)

(72) Inventors: Haitham Aljuaydi, Al-Kharj (SA); Faisal M. Alissa, Dhahran (SA); Mohammad A. Aleissa, Safwa (SA); Ali Sadah, Safwa (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/341,662

(22) Filed: Jun. 26, 2023

(65) Prior Publication Data

US 2024/0426193 A1 Dec. 26, 2024

(51) Int. Cl.

| | |
|---|---|
| ***E21B 37/02*** | (2006.01) |
| ***E21B 36/04*** | (2006.01) |
| ***E21B 37/06*** | (2006.01) |
| ***E21B 47/10*** | (2012.01) |

(52) U.S. Cl.

CPC ..... *E21B 37/02* (2013.01); *E21B 36/04* (2013.01); *E21B 37/06* (2013.01); *E21B 47/10* (2013.01)

(58) Field of Classification Search

CPC ..... E21B 36/04; E21B 37/02; E21B 37/04; E21B 37/045; E21B 37/06

See application file for complete search history.

(56) References Cited

U.S. PATENT DOCUMENTS

| | | | | |
|---|---|---|---|---|
| 4,438,812 | A * | 3/1984 | Hammon | E21B 37/02 166/173 |
| 4,612,986 | A * | 9/1986 | Fosdick, Jr. | E21B 37/08 166/170 |
| 7,201,238 | B2 | 4/2007 | Marvin et al. | |
| 7,874,355 | B2 | 1/2011 | O'Keefe et al. | |
| 8,136,587 | B2 * | 3/2012 | Lynde | E21B 37/02 166/173 |
| 2007/0261855 | A1 * | 11/2007 | Brunet | E21B 37/02 166/173 |
| 2013/0192818 | A1 * | 8/2013 | Winn | E21B 37/02 166/173 |
| 2014/0311528 | A1 * | 10/2014 | Hallundb | C23F 11/173 134/22.12 |
| 2019/0055820 | A1 * | 2/2019 | Coyle, Jr. | E21B 37/02 |
| 2022/0243560 | A1 * | 8/2022 | Al-Huwaider | E21B 37/02 |

FOREIGN PATENT DOCUMENTS

AU 2014323242 B2 2/2017

* cited by examiner

*Primary Examiner* — Robert E Fuller

(74) *Attorney, Agent, or Firm* — Vorys, Sater, Seymour and Pease, LLP

(57) ABSTRACT

A bottom hole assembly includes a production logging tool including a spinner flowmeter for determination of flow velocity within production tubing, and a downhole scale removal tool coupled to the production logging tool. The downhole scale removal tool includes an elongate body defining an internal flowpath therein, one or more openings defined on an outer surface of the elongate body, the one or more openings fluidly coupled to the internal flowpath, and a plurality of solid bristles disposed on an outer surface of the elongate body and extending radially from the elongate body.

14 Claims, 4 Drawing Sheets

DOWNHOLE SCALE REMOVAL TOOL

FIELD OF THE DISCLOSURE

The present disclosure relates generally to production logging in oil and gas wells and, more particularly, to facilitating production logging operations by removing scale with a downhole scale removal tool having rotary jets and mechanical protrusions.

BACKGROUND OF THE DISCLOSURE

Within producing wells, one or more components of crude oil or other production fluids may precipitate and adhere to the walls of production tubing. This precipitation may form scale deposits on the walls that accumulate as further deposition occurs. One component that commonly forms scale deposits is paraffin wax. Depositions of paraffin wax are notoriously problematic as production within the well may be restricted and the effective diameter of the production tubing may be reduced due to the buildup of paraffin wax scale.

While monitoring and assessing active wells, production logging tools may be deployed downhole to determine properties such as the production contributions from individual zones within a producing reservoir. These production logging tools may commonly utilize spinner flowmeters which rotate when impinged by production fluids flowing within the production tubing such that the velocity of the production fluids and other parameters of reservoir production may be assessed. However, the presence of any scale deposits within the production tubing may frustrate the introduction of production logging tools downhole. Further, paraffin wax deposits may hinder the rotation of the spinner flowmeters, which may result in inaccurate assessments of the flow. As such, production logging tools may operate more efficiently and accurately in the absence of scale deposits. Techniques have been developed for removing scale deposits that involve jetting chemicals downhole to dislodge and dissolve the scale. However, jetting operations may necessitate the removal of an entire logging tool string in order to run scale removal tools. As such, the cost and downtime associated with jetting operations to clean scale deposits may limit the frequency of scale removal operations. Further, jetting operations rely upon chemical reactions and pumping pressure for scale removal which may fail to effectively remove all scale deposits.

Accordingly, a downhole scale removal tool with multiple modes of scale cleaning which may be incorporated into existing tool strings is desirable.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a bottom hole assembly includes a production logging tool including a spinner flowmeter for determination of flow velocity within production tubing, and a downhole scale removal tool coupled to the production logging tool. The downhole scale removal tool includes an elongate body defining an internal flowpath therein, one or more openings defined on an outer surface of the elongate body, the one or more openings fluidly coupled to the internal flowpath, and a plurality of solid bristles disposed on an outer surface of the elongate body and extending radially from the elongate body.

In another embodiment, a downhole scale removal tool includes a coupling for coupling the downhole scale removal tool to a downhole conveyance, the coupling defining an internal cavity, a threaded connection on a proximal end thereof, and an aperture on a distal end thereof. The downhole scale removal tool further includes a rotary motor installed within the internal cavity of the coupling, a shaft of the rotary motor protruding through the aperture of the coupling, a flange mated to the shaft of the rotary motor and attached to a proximal end of an elongate body, one or more openings defined on an outer surface of the elongate body, the one or more openings fluidly coupled to a source of cleaning fluid, and a plurality of solid bristles extending radially from the elongate body and spaced along a length of the elongate body.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
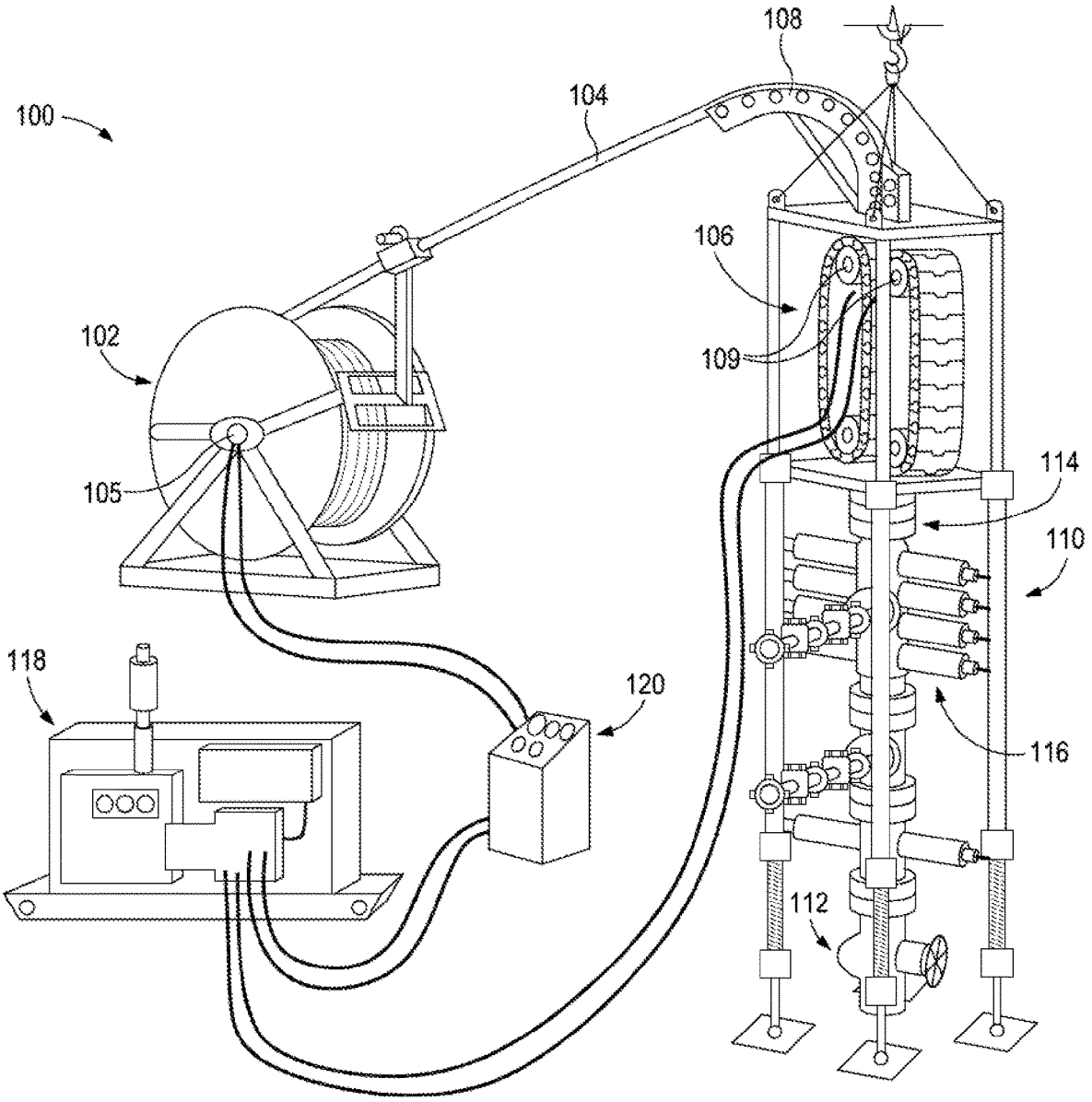
FIG. 1 is a schematic diagram of an example coiled tubing system upon which a scale removal tool employing the principles of the present disclosure may be deployed.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to production logging in oil and gas wells and, more particularly, to facilitating production logging operations by removing scale with a downhole scale removal tool with rotary jets and mechanical protrusions. Embodiments disclosed herein may include a downhole scale removal tool which incorporates both jetting nozzles for spraying chemical solvents and solid bristles for mechanical scale removal when deployed downhole. The downhole scale removal tool may be deployed with electrical-coiled tubing, independently or along with a production logging tool, which may include a spinning flowmeter. The downhole scale removal tool may remove scale deposits via the chemical solvent, the mechanical scraping of the solid bristles, as well as via melting due to heat generated by the solid bristles or other components of the scale removal tool. The downhole scale removal tool may provide optimized scale removal, while saving costs and downtime via deployment as part of a production logging bottom hole assembly.

FIG. 1 is a schematic diagram of an example coiled tubing system 100 that may employ the principles of the present disclosure. As illustrated, the coiled tubing system 100 (hereafter "the system 100") includes a spool or "reel" 102, which serves as a storage apparatus for coiled tubing 104. The coiled tubing 104 comprises a continuous length of flexible pipe capable of being wound onto and unwound from the reel 102. In some applications, the reel 102 may be mounted to a transport vehicle, such as a truck, but could alternatively be mounted to a production rig or may otherwise be skid-mounted. Rotation of the reel 102 may be controlled by a hydraulic motor 105 mounted as a direct drive on the reel 102 or operated by a chain-and-sprocket drive assembly (not shown).

The coiled tubing 104 is guided from the reel 102 to an injector assembly 106 via a tubing guide arch 108, alternately referred to as a "gooseneck." The tubing guide arch 108 supports the coiled tubing 104 through a bending radius, for example 90°, and guides the coiled tubing 104 into the injector assembly 106. The injector assembly 106, alternately referred to as an "injector head," is designed to grip the outer diameter of the coiled tubing 104 and provide the force required to convey the coiled tubing 104 into a wellbore and subsequently retrieve the coiled tubing 104. The injector assembly 106 is designed to support the full weight of the coiled tubing 104, and allows an operator to control the rate of lowering the coiled tubing 104 into a wellbore (not shown) drilled into an underlying earth surface.

Various designs and configurations of the injector assembly 106 may be used in accordance with the principles of the present disclosure. For example, the injector assembly 106 can include, but is not limited to, an opposed counter-rotating, chain drive system, an arched-chain roller drive system, a single-chain, opposed gripper-drive system, a sheave drive system, or any combination thereof. In the illustrated embodiment, the injector assembly 106 is depicted as a vertically mounted, counter-rotating chain drive system. As will be described in more detail below, the injector assembly 106 may include opposing, sprocket-driven traction chains powered by counter-rotating hydraulic motors 109, but could alternatively be driven by other means, without departing from the scope of the disclosure.

The system 100 may further include a well control stack 110 operatively coupled to the injector assembly 106 and interposing the injector assembly 106 and a wellhead 112, which constitutes the surface termination of the wellbore drilled into the underlying earth surface. The well control stack 110 can include, for example, a stripper assembly 114 and a blowout preventer or "BOP" 116. The stripper assembly 114 interposes the injector assembly 106 and the BOP 116 and provides the necessary pressure control and lubrication for the coiled tubing 104 as the coiled tubing 104 is conveyed downhole or retrieved.

The BOP 116 may comprise a plurality of hydraulically-operated rams. For example, the BOP 116 can include one or more blind rams, tubing shear rams, slip rams, and pipe rams. The blind rams may be used to seal off the wellbore at the surface if well control is lost. The tubing shear rams may be used to mechanically break (sever) the coiled tubing 104 in the event the coiled tubing 104 becomes stuck within the well control stack 110 or whenever it may be necessary to cut the coiled tubing 104 and remove the surface equipment from the well. The slip rams may include bidirectional teeth, which, when activated, secure against the coiled tubing 104 and support the weight of the coiled tubing 104 and any tools or assembly coupled thereto. The pipe rams may be equipped with elastomer seals and may be used to isolate the wellbore annulus pressure below the BOP 116.

The system 100 may further include a power source 118 (alternately referred to as a "power pack") used to power operation of the injector assembly 106 and the reel 102. In some applications, the power source 118 may comprise a hydraulic-pressure pump system including one or more multistage hydraulic pumps powered by one or more diesel engines. Alternatively, the power source 118 may comprise an electric generator system. The power source 118 may be designed to convey hydraulic fluid to operate various components of the system 100, such as the reel 102 and the injector assembly 106. In particular, among other operations, hydraulic fluid may be conveyed to operate the hydraulic motors 105, 109 of the reel 102 and the injector assembly 106, respectively, and thereby selectively control movement of the coiled tubing 104.

In some applications, the system 100 may also include a control console 120 in communication with the power source 118. The control console 120 can include various controls and gauges required to operate and monitor all of the components during operation of the system 100. An operator may be able to control operation of all facets of the system 100 from the control console 120. The hydraulic motors 105, 109 of the reel 102 and the injector assembly 106 may be activated (operated) via the control console 120, which may be configured to manipulate one or more valves that determine the direction of motion for the coiled tubing 104 and operating speed and braking. In at least one application, one or both of the power source 118 and the control console 120 may be positioned on a transport vehicle along with the reel 102, but could alternatively comprise skid-mounted components. The control console 120, for example, may be arranged within a control cabin mounted to the bed of a truck.

Figure 2A:
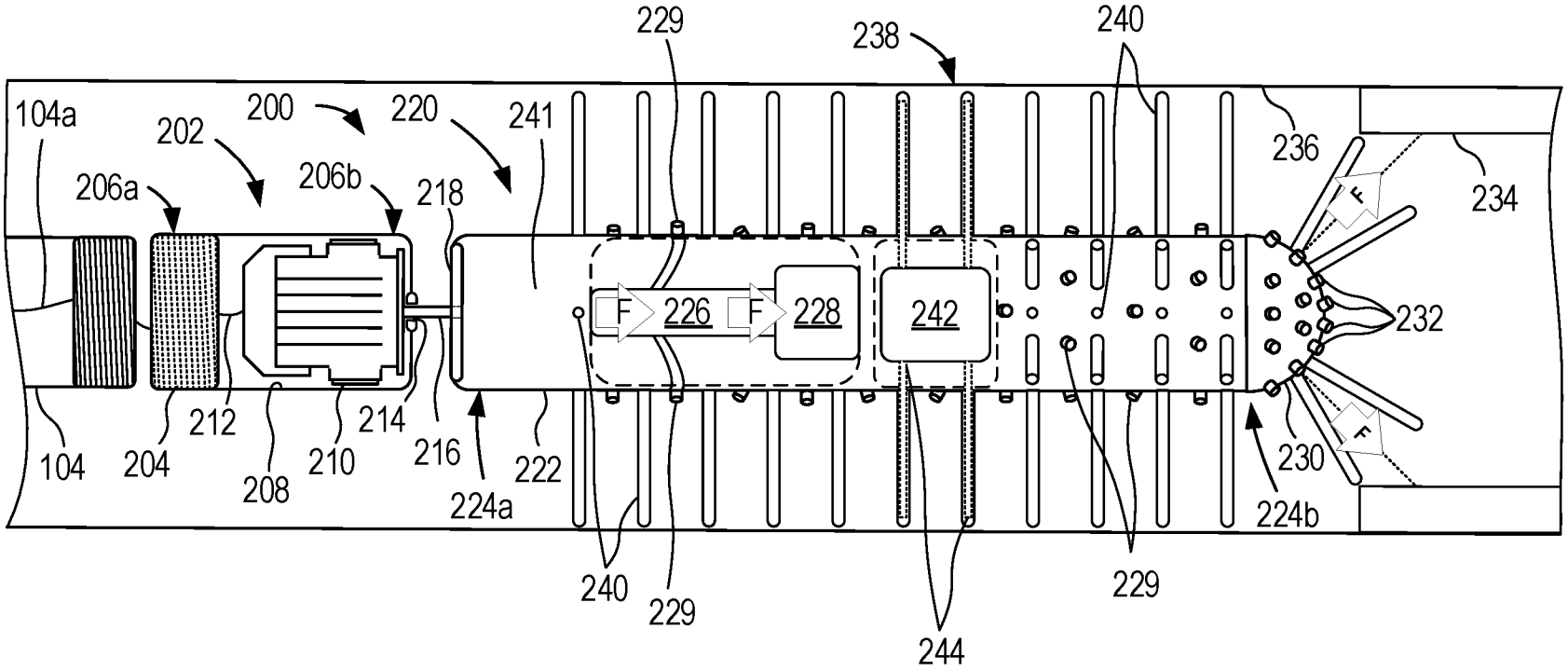
FIG. 2A is a schematic diagram of an example downhole scale removal tool, according to one or more embodiments of the disclosure.
Figure 2B:
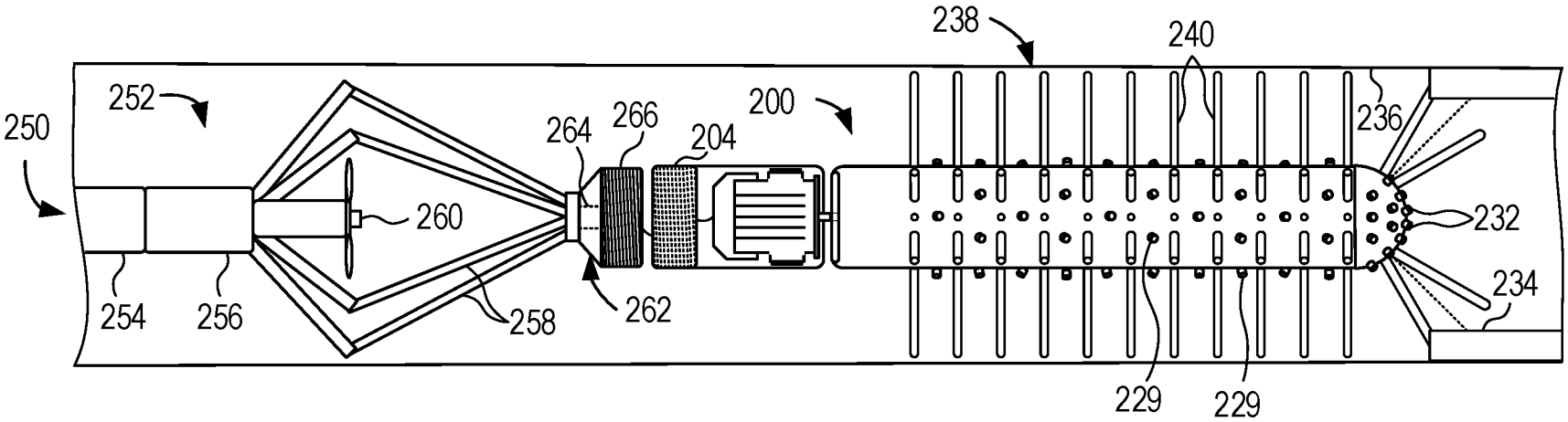
FIG. 2B is a schematic diagram of a bottom hole assembly including the example downhole scale removal tool of FIG. 2A attached to a Production Logging Tool (PLT), according to one or more embodiments of the disclosure.

FIG. 2A is a schematic diagram of an example downhole scale removal tool 200, according to one or more embodiments of the disclosure. The example downhole scale removal tool 200 (hereinafter, "the tool 200") may include a coupling 202 for attaching the tool 200 to coiled tubing 104, another downhole conveyance, or other components of a bottom-hole assembly 250 (FIG. 2B). Accordingly, the coupling 202 may include a threaded connection 204 on a proximal end 206*a* to facilitate attachment of the tool 200 to further equipment. In some embodiments, the coupling 202 may include an electrical connector (not shown) for coupling the tool 200 to an electrical cable 104*a* extending through the coiled tubing 104. The coupling 202 may further define an internal cavity 208 in which a rotary motor 210 is housed. The rotary motor 210 may be inserted into the internal cavity 208 and positioned at a distal end 206*b* of the coupling 202. Wiring 212 of the rotary motor 210 may be run through the internal cavity 208 and through the threaded connection 204 for coupling the rotary motor 210 to the electrical cable 104*a*. The electrical cable may be operatively coupled to the control console 120 (FIG. 1) to permit remote operation of the rotary motor 210. An aperture 214 may further be defined at the distal end 206*b* of the coupling 202. The aperture 214 may enable a shaft 216 of the rotary motor 210 to protrude from the coupling 202.

The shaft 216 protruding from the rotary motor 210 may be mated to a flange 218 on a rotational portion 220 of the tool 200. In some embodiments, the shaft 216 may be adhered, welded, brazed or otherwise attached to the flange 218, such that the rotary motor 210 may provide torque to the rotational portion 220 via the shaft 216. The rotational portion 220 may include an elongate body 222 which extends from the proximal end 224*a* of the rotational portion 220. The elongate body 222 may be partially hollow, such that one or more internal flowpaths 226 and one or more internal reservoirs 228 are included therein. The one or more internal flowpaths 226 may receive a cleaning fluid F from the coiled tubing 104 via one or more fluid conduits within the flange 218, and may transfer the cleaning fluid F into the one or more internal reservoirs 228. In some embodiments, the one or more fluid conduits may pass through a shaft of the rotary motor 210, a rotary or swivel fitting (not shown) or other appropriate mechanisms as recognized in the art for conveying fluid from a stationary component to a rotary component. Accordingly, the one or more internal reservoirs 228 may be in fluid communication with lateral openings 229 defined along the elongate body 222 and a jetting head 230 on a distal end 224*b* of the rotational portion 220. The cleaning fluid F may be a jetting or cleaning fluid, such as a chemical solvent, designed to remove scale buildup.

The jetting head 230 may include a plurality of jetting nozzles 232 which are arranged within the jetting head 230. The plurality of jetting nozzles 232 may be aimed radially away from the jetting head 230 and rotational portion 220, such that jets of cleaning fluid F may be produced towards a surrounding area. The plurality of jetting nozzles 232 may produce the jets of cleaning fluid F toward scale deposits 234 which have accumulated on the interior walls 236 of production tubing 238. Accordingly, the cleaning fluid F may be formulated such that the chosen chemical solvent may break down or dissolve the scale deposits 234 in the production tubing 238 of interest. For example, the cleaning fluid F may include acetone, kerosene, diesel, hexane, toluene, organic solvents (e.g., organophosphonate esters), and/or ether. As the rotary motor 210 provides torque to the rotational portion 220, the lateral openings 229, jetting head 230 and jetting nozzles 232 may subsequently rotate to distribute the fluid F circumferentially around the interior walls 236.

As the lateral openings 229, jetting head 230 and jetting nozzles 232 spread the cleaning fluid F along the inner walls 236 and the cleaning fluid F begins dissolving the scale deposits 234, the tool 200 may be advanced axially through the production tubing 238. During axial advancement of the tool 200 and rotation of the rotational portion 220, a plurality of solid bristles 240 disposed on the outer surface 241 of the elongate body 222 may contact the dissolving scale deposits 234. The plurality of solid bristles 240 may be attached to the outer surface 241 of the elongate body 222 via a threaded connection, one or more fasteners, welding, brazing, or adhesives. The solid bristles 240 protrude radially from the elongate body 222 and may also be included on the jetting head 230. In some embodiments, the plurality of solid bristles 240 may be formed of one or more strands of a metal such as brass, bronze or spring steel wire. Additionally or alternatively, the solid bristles 240 may be constructed of natural fibers or synthetic filaments such as nylon, PVC, or styrene. The rotation of the rotational portion 220 may spin the plurality of solid bristles 240 at or near the interior walls 236 of the production tubing 238. Accordingly, the dissolving scale deposits 234 may be contacted or scraped by the plurality of solid bristles 240 and pulled away from the interior walls 236. The combination of the chemical reaction from the cleaning fluid F and the mechanical scraping action of the solid bristles 240 may contribute to removal of the scale deposits 234. As such, further operations within the production tubing 238 may be performed with greater confidence that scale deposits 234 have been sufficiently removed.

Further, the scale removal tool 200 may generate heat within the elongate body 222 and/or the plurality of solid bristles 240, such that any scale collected on the solid bristles 240 may be melted, thus cleaning the plurality of solid bristles during operation. In some embodiments, a resistive heater 242 may be included within the elongate body 222. The resistive heater 242 may be operatively coupled to the electrical cable 104*a* or wiring 212, such that heat is generated within the elongate body 222. In further embodiments, the resistive heater 242 may include one or more heater extensions 244 which are disposed within the plurality of solid bristles 240. The one or more heater extensions 244 may generate or transfer heat into the plurality of solid bristles 240. Accordingly, the resistive heater 242 and one or more heater extensions 244 may enable melting of attached scale for cleaning of the plurality of solid bristles 240 and the elongate body 222.

FIG. 2B is a schematic diagram of the example downhole scale removal tool 200 attached within a bottom hole assembly 250, according to one or more embodiments of the disclosure. The bottom hole assembly 250 (hereinafter, "the BHA 250") may be utilized in production logging operations within the production tubing 238. Accordingly, the BHA 250 may include a production logging tool 252 (hereinafter, "the PLT 252") for assessment of the reservoir production downhole. The PLT 252 may include a measurement sonde 254, partially shown here, which may include a plurality of sensors, batteries, and computer-readable storage mediums for data collection and storage. The PLT 254 may further include a spinner flowmeter 256 which may sense flow velocities within the production tubing 238. The spinner flowmeter 256 may include expandable arms 258 which may be spread to cover a full bore of the production tubing 238. The spinner flowmeter 256 may further include one or more impellers 260 which rotate in response to a production fluid impinging thereupon as the production fluid flows uphole. The rotation of the impellers 260 may be analyzed to estimate a velocity of the production fluid, for example.

The expandable arms 258 may be disposed at or near the interior walls 236 of the production tubing 238 to radially position the impeller 260 within the production tubing. If scale deposits 234 are present as the spinner flowmeter 256 passes through the production tubing 238, the expandable arms 258 may become lodged, damaged, or impeded, or may interfere with the radial position of the impeller 260. Any interference with the expandable arms 258 may negatively affect results of the production logging by the PLT 252. Accordingly, a distal end of the PLT 252 may be coupled to the tool 200, such that any scale deposits 234 may be removed from the interior walls 236 before the spinner flowmeter 256 arrives. The cleaning fluid F (FIG. 2A) provided through the tool 200 may also prevent the impeller 260 from becoming unduly obstructed by organic or inorganic sludge or scale deposits 234 within the production tubing 238.

The PLT 252 may be coupled to the tool 200 via an intermediate coupling 262, which may enable connection of the spinner flowmeter 256 to the tool 200. The intermediate coupling 262 may include an internal connection 264 which may be mated to the spinner flowmeter 256. The internal connection 264 may enable independent mating of the spinner flowmeter 256 to the intermediate coupling 262 with the use of a threaded connection, one or more fasteners, or any additional means of mechanical connection. The intermediate coupling 262 may further include a threaded connection 266 which is threadably matable to the threaded connection 204 of the tool 200. The intermediate coupling 262 may further serve as a flow conduit for provision of wiring and fluids to the tool 200. Accordingly, the spinner flowmeter 256 may be mated to the tool 200 without impeding operation of the spinner flowmeter 256. The attached tool 200 may then be advanced with the BHA 250, and the solid bristles 240, lateral openings 229 and jetting nozzles 232 may remove any scale deposits 234 from the interior walls 236 ahead of the spinner flowmeter 256. In some embodiments, accordingly, the plurality of solid bristles 240 extend a distance at least equal to an operational distance of the expandable arms 258. The scale deposits 234 may adhere to solid bristles 240 rather than to the spinner flow meter 256, thereby ensuring effective operation of the spinner flow meter 256.

Figure 3:
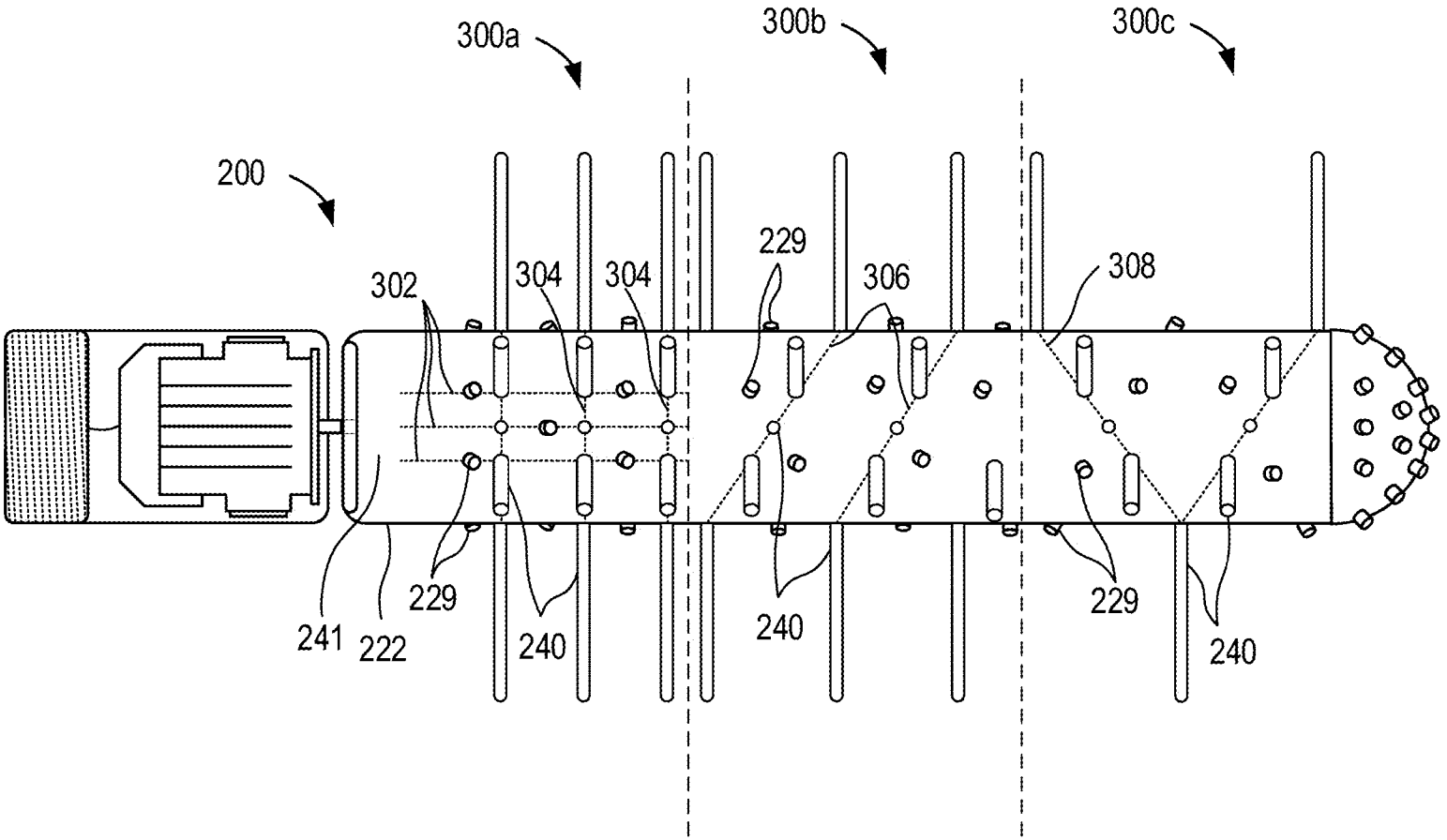
FIG. 3 is a schematic diagram the example downhole scale removal tool illustrating various bristle layouts according to one or more embodiments of the disclosure.

FIG. 3 is a schematic diagram of various bristle layouts 300*a-c*, which may be employed, in whole or in part, for the example downhole scale removal tool 200, according to one or more embodiments of the disclosure. The downhole scale removal tool 200, as discussed above, may include a plurality of solid bristles 240 disposed on the outer surface 241 of the elongate body 222. The bristle layout 300*a* may be similar to the design shown in FIGS. 2A-2B, wherein the solid bristles 240 are organized in circumferentially-spaced rows 302 and axially-spaced columns 304. The bristle layouts 300*a-c* may include a plurality of lateral openings 229 interspersed throughout the plurality of solid bristles 240, as illustrated. The lateral openings 229 may be additionally arranged or organized into differing patterns based upon the bristle layouts 300*a-c*.

The bristle layout 300*b* may provide the plurality of solid bristles 240 in a double-helical shape on the elongate body 222. The plurality of solid bristles 240 may form diagonal or curved patterns 306 across the elongate body 222. The bristle layout 300*b* may provide fewer overall solid bristles 240 than the bristle layout 300*a*, but may yield similar performance utilizing varying rotational and axial speeds.

As with the bristle layout 300*b*, the bristle layout 300*c* may provide a smaller plurality of solid bristles 240 in a zig-zagging shape on the elongate body 222. The plurality of solid bristles 240 may form a v-shaped pattern 306 across both sides of the elongate body 222. Similar to the bristle layout 300*b*, the bristle layout 300*b* may provide fewer overall solid bristles 240 than bristle layout 300*a* while providing similar performance.

The bristle layouts 300*a-c* may be employed for the tool 200 depending upon the characteristics of the producing well, the type of scale deposits which may be present in the well, the amount of deposited scale in the well, the speed of the rotary motor (e.g., the rotary motor 210 of FIG. 2A-2B), and the characteristics of the coiled tubing (e.g., the coiled tubing 104 of FIGS. 1-2A) used. Each bristle layout 300*a-c* may provide advantages based upon the situation, and further bristle layouts may be chosen that are not shown herein. Further, the plurality of solid bristles 240 and lateral openings 229 may be randomly disposed on the elongate body 222 without any chosen bristle layout.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A bottom hole assembly, comprising:

a production logging tool including a spinner flowmeter for determination of flow velocity within production tubing; and a downhole scale removal tool coupled to the production logging tool, the downhole scale removal tool including:

an elongate body defining an internal flowpath therein;

one or more openings defined on an outer surface of the elongate body, the one or more openings fluidly coupled to the internal flowpath;

a plurality of solid bristles disposed on an outer surface of the elongate body and extending radially from the elongate body;

a coupling for coupling the downhole scale removal tool to a downhole conveyance, the coupling defining an internal cavity, a threaded connection on a proximal end, and an aperture on a distal end;

a rotary motor installed within the internal cavity of the coupling;

a shaft of the rotary motor protruding through the aperture of the coupling; and a flange mated to the shaft of the rotary motor and attached to a proximal end of the elongate body.

2. The bottom hole assembly of claim 1, wherein the elongate body of the downhole scale removal tool is rotatable with respect to the production logging tool.

3. The bottom hole assembly of claim 1, wherein the spinner flowmeter includes a plurality of expandable arms, and wherein the plurality of solid bristles extend a distance at least equal to an operational distance of the expandable arms.

4. The bottom hole assembly of claim 1, wherein the elongate body includes one or more internal reservoirs containing a fluid therein, the one or more reservoirs fluidly coupled to the one or more openings defined on the outer surface of the elongate body.

5. The bottom hole assembly of claim 4, wherein the fluid provided within the one or more internal reservoirs is selected from a group consisting of acetone, kerosene, diesel, hexane, toluene, ether, an organic solvent, and a combination thereof.

6. The bottom hole assembly of claim 1, wherein the downhole scale removal tool further includes a resistive heater within the elongate body.

7. A downhole scale removal tool, comprising:

a coupling for coupling the downhole scale removal tool to a downhole conveyance, the coupling defining an internal cavity, a threaded connection on a proximal end thereof, and an aperture on a distal end thereof;

a rotary motor installed within the internal cavity of the coupling;

a shaft of the rotary motor protruding through the aperture of the coupling;

a flange mated to the shaft of the rotary motor and attached to a proximal end of an elongate body;

one or more openings defined on an outer surface of the elongate body, the one or more openings fluidly coupled to a source of cleaning fluid; and a plurality of solid bristles extending radially from the elongate body and spaced along a length of the elongate body.

8. The downhole scale removal tool of claim 7, further comprising a resistive heater installed within the elongate body.

9. The downhole scale removal tool of claim 8, further comprising one or more heater extensions extending from the resistive heater into the plurality of solid bristles.

10. The downhole scale removal tool of claim 7, wherein the plurality of solid bristles are arranged in circumferentially-spaced rows and axially-spaced columns on the outer surface of the elongate body.

11. The downhole scale removal tool of claim 7, wherein the plurality of solid bristles are arranged in a double-helical pattern on the outer surface of the elongate body.

12. The downhole scale removal tool of claim 7, wherein the elongate body includes one or more internal flowpaths and one or more internal reservoirs in fluid communication with the one or more openings and a plurality of jetting nozzles embedded in the outer surface of the elongate body.

13. The downhole scale removal tool of claim 7, wherein the plurality of solid bristles are formed of brass, bronze, spring steel wire, nylon, PVC, styrene, or a combination thereof.

14. The downhole scale removal tool of claim 7, wherein the plurality of solid bristles are attached to the outer surface of the elongate body via a threaded connection, one or more fasteners, welding, brazing, adhesives, or a combination thereof.

* * * * *